US010458093B2

(12) United States Patent
Gilbert

(10) Patent No.: US 10,458,093 B2
(45) Date of Patent: Oct. 29, 2019

(54) ON-SITE MANHOLE CASTING SYSTEM

(71) Applicant: Jeffrey Allan Gilbert, Henderson, NV (US)

(72) Inventor: Jeffrey Allan Gilbert, Henderson, NV (US)

( * ) Notice: Subject to any disclaimer, the term of this patent is extended or adjusted under 35 U.S.C. 154(b) by 0 days.

(21) Appl. No.: 15/784,450

(22) Filed: Oct. 16, 2017

(65) Prior Publication Data

US 2019/0112778 A1 Apr. 18, 2019

(51) Int. Cl.
*E02D 29/14* (2006.01)
*E02D 29/12* (2006.01)
*B65D 90/10* (2006.01)

(52) U.S. Cl.
CPC ..... *E02D 29/14* (2013.01); *B65D 90/10* (2013.01); *E02D 29/124* (2013.01)

(58) Field of Classification Search
CPC ..... E02D 29/14; E02D 29/124; B65D 90/10
See application file for complete search history.

(56) References Cited

U.S. PATENT DOCUMENTS 1,504,264 A 8/1924 Nelson
2,166,632 A * 7/1939 Hardesty ..... E02D 29/12 405/133
3,729,165 A * 4/1973 Trimble ..... B28B 7/168 249/1
4,123,033 A * 10/1978 Joelson ..... B28B 7/0011 249/100
4,666,333 A * 5/1987 Armstrong ..... E02D 29/14 404/25
4,995,584 A 2/1991 Trimble
5,032,197 A 7/1991 Trimble
5,198,246 A 3/1993 Bowen
5,271,193 A * 12/1993 Olsen ..... B28B 7/38 52/169.7
5,386,669 A 2/1995 Almeida
5,634,739 A * 6/1997 Armstrong ..... E02D 29/12 404/26
5,901,506 A 5/1999 Zicaro et al.
5,928,447 A * 7/1999 GianFrancisco ..... E03F 3/06 138/97
6,959,903 B1 11/2005 West et al.
8,646,223 B2 2/2014 Brewka et al.
9,169,957 B2 10/2015 Kiest, Jr.
2002/0124502 A1* 9/2002 Henderson ..... E02D 27/42 52/296
2006/0065994 A1* 3/2006 Del Zotto ..... B28B 1/087 264/71

(Continued)

*Primary Examiner* — Abigail A Risic
(74) *Attorney, Agent, or Firm* — The Thornton Firm, LLC; Scott D. Thornton

(57) ABSTRACT

A permanent on-site manhole casting system comprising a top, a main barrel, and a base. Each component consists of a ribbed plastic outer barrel and a ribbed plastic inner barrel with a plurality of plastic tie strips used to connect the said outer and inner barrels. A coupling mechanism consisting of a plastic outer coupling ring and a plastic inner coupling ring is welded to the coupling ends of the top, main barrel and base which connects the top, main barrel and base components. A concrete mixture is poured into the space between the coupled outer and inner barrels where the concrete is then allowed to set and cure and the filled form is then completely buried.

19 Claims, 7 Drawing Sheets

(56) References Cited

U.S. PATENT DOCUMENTS

| | | | | |
|---|---|---|---|---|
| 2007/0144606 | A1* | 6/2007 | O'Brien | B65D 90/105 141/86 |
| 2012/0210653 | A1* | 8/2012 | Tate | E02D 29/14 52/20 |
| 2014/0115975 | A1* | 5/2014 | Bussio | F16L 1/038 52/19 |
| 2018/0355577 | A1* | 12/2018 | Barton | E02D 29/149 |

* cited by examiner

ON-SITE MANHOLE CASTING SYSTEM

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

The invention relates generally to the field of casting systems for concrete pipe and utility structures. More specifically, the present invention relates to an on-site casting system for pouring ready mix concrete into pre-formed, manufactured molds.

2. Description of the Related Art

One of the oldest forms of civil engineering and infrastructure construction is the use of underground pipes and conduits. The use of such conduits has been integral to the process of both delivering water into cities and draining storm water and sewage away from them. From the days of ancient Rome to today's modern societies, underground conduit design has evolved from the use of spread-on clay, to the fitting of brick and mortar to today's use of reinforced concrete pipes. Not only have underground conduits evolved in their design, but they have evolved in their usage as well. Today, underground conduits are used for a wider variety of services than simply water and sanitary sewer systems. Underground conduits are used for electrical and telecommunications systems as well. And along with the evolution of underground conduit technology, access to such underground conduits has evolved as well.

The most widely used method of accessing underground conduits involves the use of manholes. Manholes are essentially a top opening to underground utility conduit systems housing an access point for making connections, inspecting systems, adjusting components such as valves and pumps, or performing maintenance on underground conduits such as water pipes, gas mains, steam pipes, sanitary sewer systems, storm drains, telecommunications systems, and electrical power grids.

The current industry standard employs the use of concrete structures that are pre-cast and delivered to construction sites. Manhole components are generally made by designing a desired shape and then creating and building large form boxes to serve as molds. The form boxes are then filled with Portland cement or concrete mixtures which can be blended to meet varying industry requirements. The concrete is then allowed to cure for a required length of time. When the concrete cures, the forms are removed and reused. Components are then shipped to a work site where they are placed in an open excavation and fitted with varying conduits. The fitted assemblies are then buried.

Limitations in the current industry standard include the fact that there are very few pre-casting plants in any general area due to factors such as plant size, resource costs and limited demand for such components. Such economic factors generally create regional monopolies which drive prices higher. Additionally, pre-casting manhole components takes time to perform at a plant. In general, it can take up to five days for concrete to set in a form. It also takes up to twenty-eight days for certain types of concrete to cure before the set concrete structures can be transported to a site to prevent cracking during transport. Transportation of cured concrete structures from a regional plant to a construction site generally involves using a crane to load the precast structures on and off a flatbed trailer, where a standard semi-trailer truck then hauls the components to the site. The structures require some form of heavy equipment to unload them, and lower said structures into an excavation. This process can not only be time-consuming, but highly expensive due to heavy equipment operation costs.

An additional limitation with the current industry standard is that concrete manhole structures are susceptible to long-term corrosion from exposure to ionic minerals and gases such as Hydrogen Sulfide. Such corrosion requires manholes to be serviced, repaired and ultimately replaced premature to the expiration of their natural service life. Such servicing generally involves the surfaces being coated with a bituminous material such as tar or asphalt. Other coatings such as epoxies or acrylic paints may be used. Plastic retrofit systems are also available, which involve lining existing structures with plastic components. These servicing methods, though, are not permanent, and require regular maintenance intervals.

Despite numerous advances and retrofit systems available, though, there still exists a need for a low cost, light weight, on-site form system which provides for a manhole assembly with the same or greater strength and functionality, meeting or exceeding current industry specifications which can enable a manhole assembly to be produced and put into service in less time.

SUMMARY

The object of the present invention is to provide a permanent on-site casting system for the making of concrete utility structures and pipe used underground as integral components of utility systems such as sanitary sewer systems, storm drain systems and electrical and communications systems. Such a manhole casting system will significantly reduce the time and cost of casting and delivering pre-cast concrete components to remote locations. Furthermore, such an on-site casting system will eliminate the need for larger pre-cast concrete plants and the resources required to produce manhole components from such regional locations.

It is another object of the present invention to provide for greater protection of storm drains from corrosion caused by various reactive compounds in both the fluids carried by the system and by exposure to the surrounding environment. This is achieved through the use of a plastic liner on both the outside and inside of the manhole assembly.

It is a further object of the present invention to provide a single, structurally stronger and longer lasting manhole assembly. The use of a casting system which becomes a lasting part of the overall structure offers a single, contiguous, integrally cast and stronger structure capable of withstanding greater elemental and environmental exposure.

The technology of the on-site manhole casting system operates through the use of manufactured plastic forms which are fabricated at a production facility and delivered to a construction site, assembled and configured on-site, set in place, and are integrally filled with a concrete mixture. The forms, once filled with concrete, may be allowed to cure on-site and in place. The finished structure will be structurally stronger and more resistant to environmental exposure.

The on-site manhole casting system employs the use of light weight, relatively thin walled plastic forms which are assembled to order, and delivered to a construction site. The forms are placed into a prepared excavation site, fitted to underground conduits or pipes, and are then filled with concrete through the use of a ready mix concrete truck, allowed a given time for the concrete to set. The forms may be buried prior to the pouring of concrete or after depending on varying requirements. Such a system can serve as a superior alternative to related art which provides a manhole equal, if not better, in strength and function. Furthermore, such as system could produce concrete forms into service in days and not weeks.

BRIEF DESCRIPTION OF THE DRAWINGS

The invention directed by way of example, and not by way of limitation, in the figures of the accompanying drawings and in which like reference numerals refer to similar elements and in which.

Figure 1:
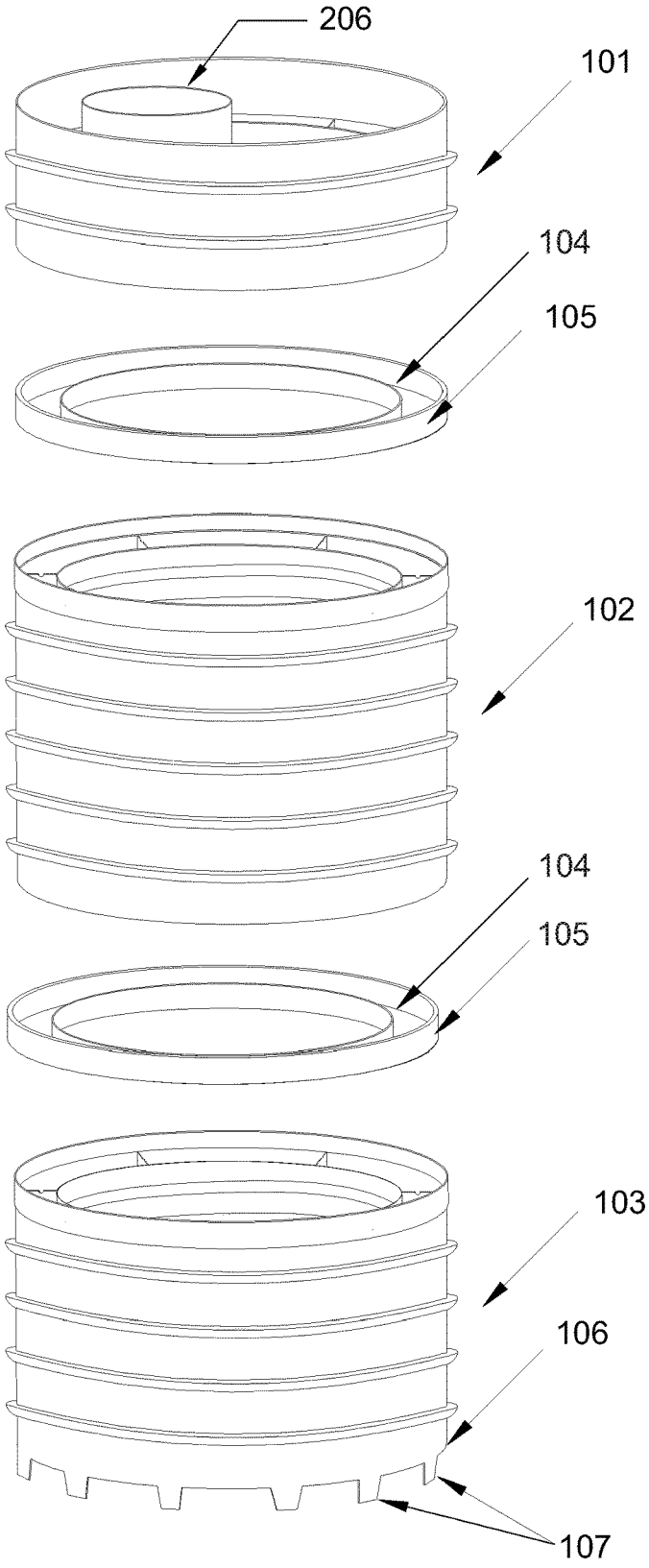
FIG. 1 is an exploded perspective illustration of an exemplary on-site manhole casting system in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "one variant," "an embodiment," "a variant," "various embodiments," "numerous variants," etc., may indicate that the embodiment(s) of the invention so described may include particular features, structures, or characteristics. However, not every embodiment or variant necessarily includes the particular features, structures, or characteristics. Further, repeated use of the phrase "in one embodiment," or "in an exemplary embodiment," or "a variant," or "another variant," do not necessarily refer to the same embodiment although they may. A description of an embodiment with several components in communication with each other does not imply that all such components are required. On the contrary, a variety of optional components are described to illustrate the wide variety of possible embodiments and/or variants of the present invention.

As is well known to those skilled in the art, many careful considerations and compromises typically must be made when designing the optimal manufacture or commercial implementation of such an on-site manhole casting system. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary on-site manhole casting system will now be described in detail with reference to embodiments thereof as illustrated in the accompanying drawings.

FIG. 1 illustrates a perspective view of an exemplary on-site manhole casting system in accordance with an embodiment of the invention. The system consists of basic components such as, but not limited to, a top component 101, a main barrel component 102, and a base component 103. Each component is fabricated to couple with one another through the use of an inner coupling ring 104 and an outer coupling ring 105. Each coupling ring may be used to chemically or thermally weld the three components together to create a single form into which a concrete mixture such as standard ready-mix concrete can be poured. Located at the bottom of the base component 103 is a footing 106 consisting of a plurality of plastic extensions 107 designed to settle in the ground of the excavation site and secure and hold the form in a true vertical position while concrete is being poured into the form.

Figure 2:
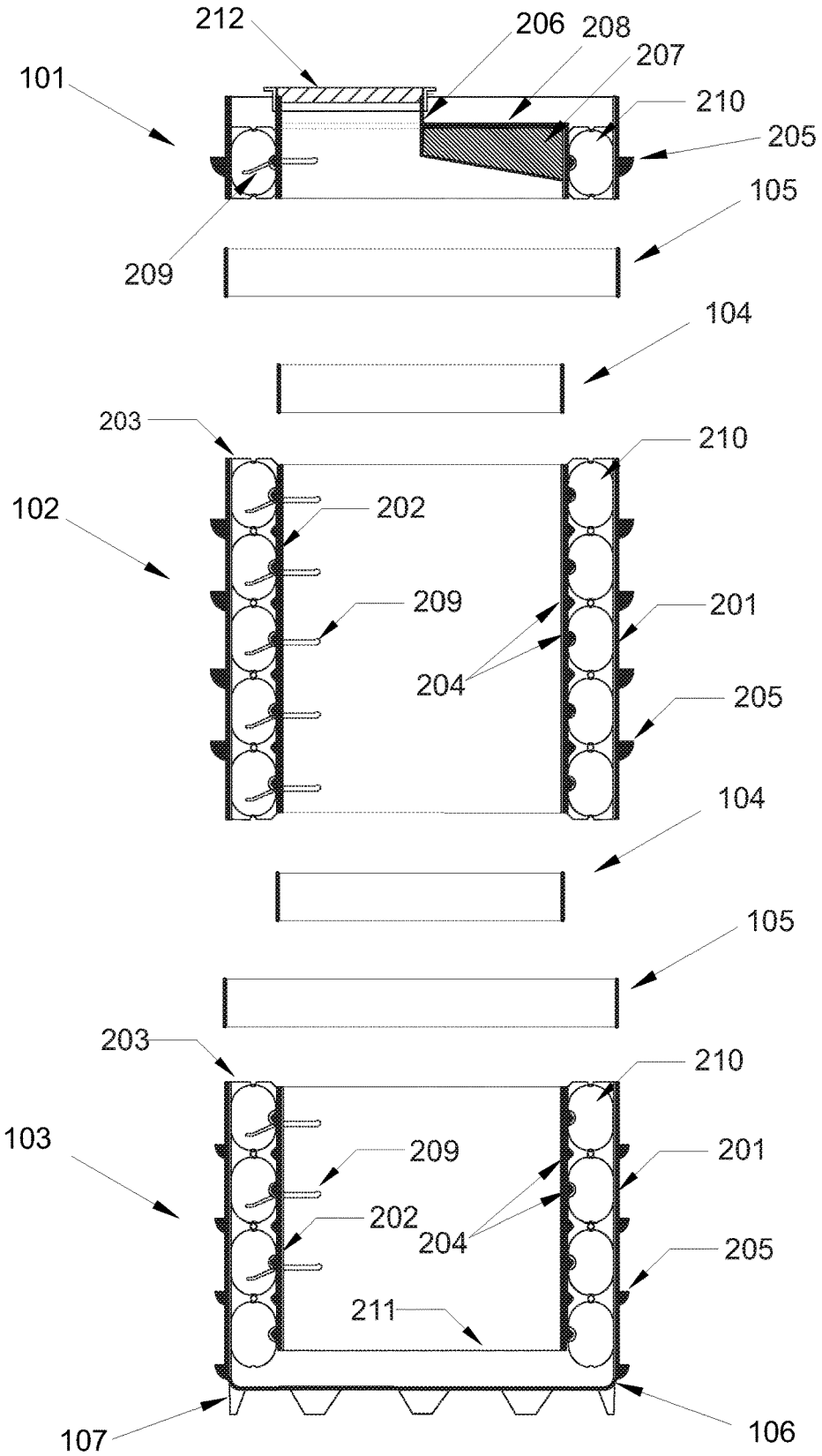
FIG. 2 is an exploded side cross sectional view of an exemplary on-site manhole casting system in accordance with an embodiment of the invention.

FIG. 2 illustrates an exploded side cross sectional view of an exemplary on-site manhole casting system in accordance with an embodiment of the invention. The base 103 is specially designed to couple with the main barrel 102, while the top 101 is also specially designed to couple with the main barrel 102. Coupling of each component is achieved through the use of an inner coupling ring 104 and an outer coupling ring 105. A step ladder is created by fixing individual steps 209 through holes drilled in the inner barrel 202. Step ladder steps 209 are inserted, and will be held in place by poured concrete.

The top component 101 is distinguishable from the other components by having a manhole entry barrel form 206, which is of a smaller diameter than the rest of the assembly and is capable of accommodating a standard manhole cover 212 assembly. The top 101 is also equipped with at least three braces radiating outward from center 207 to support a cover 208 which in turn supports the weight of concrete or earth or both, while concrete is poured into the assembled form. Persons skilled in the art will readily appreciate that braces 207 may assume many different geometric shapes, numbers and configurations. The cover 208 may be made of a thicker gauge plastic which is capable of supporting greater weight until the concrete mixture is set and cured.

The main barrel component 102 is distinguishable from the other components by having both ends capable of coupling to other components. In other embodiments of the present invention, the main barrel component 102 may be used to create piping systems for storm drains, sanitary sewer systems, aqueducts and electrical and telecommunications conduits. The main barrel's length may be cut and assembled to meet varying requirements.

The base component 103 is distinguishable from the other components by having a bottom and an integrated liner capable of incorporating various pipe fittings and sanitary sewer channels with smooth flow surfaces to facilitate more efficient flow. Additionally, the base is unique in that at the bottom of the base component 103 is a footing 106 consisting of multiple plastic extensions 107 designed to settle in the ground of the excavation site and secure and hold the form in place while concrete is being poured into the form. It will become readily apparent to persons having skill in the art that such extensions may be created in numerous fashions, and may assume numerous configurations. At the footing 106 end of the base component 103, numerous fittings and flow channel configurations may be accommodated by the exemplary on-site manhole casting system, which may be configured for a wide variety of geometrical configurations compatible with varying pipe angles, elevations and size. Persons skilled in the art will understand that numerous means for creating flow channel forms 211 and benches are available. Such means include, but are not limited to, poured concrete, plastic molding, and cement and ceramic tiles.

Each component of the exemplary on-site manhole casting system comprises an outer barrel 201 and an inner barrel 202. The barrels are attached together by a plurality of tie strips 203 spaced equally about the circumference of the barrels. In the preferred embodiment of the invention, at least six tie strips are spaced equally about the circumference of the outer barrel 201 and the inner barrel 202. The ties can be attached to the barrels by a number of methods such, but not limited to, electrofusion, hot gas welding, heat sealing, speed-tip welding, injection welding, laser welding, or solvent welding.

The three components may be coupled on-site, or they can be pre-coupled at the point of manufacture and delivered to a construction site. In the preferred embodiment of the invention, the coupling rings are chemically welded to each component with industrial adhesives and/or solvents such as cyanoacrylate. Other means of fastening the coupling rings to the components are available such as, but not limited to, electrofusion and thermal welding. The inner coupling ring 104 is welded to the inner diameter of the inner barrel 202 while the outer coupling ring is welded to the outer diameter of the outer barrel 201. Welding of the components is necessary to create a water tight seal that will protect the concrete from caustic environmental conditions.

In the preferred embodiment of the invention, the outer 201 and inner 202 barrels are made of double-walled high-density polyethylene (HDPE) of a minimum thickness. Other embodiments could be made of single-walled HDPE as well. At least one quarter of an inch thickness is recommended with extra ribbing to provide for extra support. Persons skilled in the art will appreciate that double-walled HDPE piping may be made to order with varying diameters and pipe thicknesses. Furthermore, persons skilled in the art will readily appreciate that ribbing 204, 205 of varying thicknesses and sizes may be made to order using various extrusion methods. The inner and outer barrels for each component are formed through pipe extrusion methods known and understood by persons skilled in the art. Persons skilled in the art will also understand that ribbing 204, 205 may be formed into the outer diameters of each barrel, and are spaced at equal lengths to add additional structural rigidity to each barrel while concrete is being poured into the form. The outer barrel 201 uses thicker ribbing 205 than the ribbing used by the inner barrel 202 in order provide greater rigidity and support for the outer barrel, and serve as additional buoyancy collars for use in high groundwater conditions. Such ribbing may be created by a similar method of plastic pipe extrusion used to create double-walled ribbed plastic pipe.

In various alternate embodiments of the invention, the material used for the outer and inner barrels can be a plastic such as, but limited to, polyvinyl chloride (PVC), polypropylene (PP), or polyvinylidene fluoride (PVDF). Persons skilled in the art will appreciate that additional support mechanisms such as the use of mechanical clamps or friction collars may be used if additional structural support is required until poured concrete cures and the structure is buried.

In the preferred embodiment of the invention, the ties 203 are also made of HDPE of a set thickness, preferably no less than one quarter inch. Alternative embodiments of the ties may be from similar plastics such as, but not limited to polyvinyl chloride (PVC), polypropylene (PP), or polyvinylidene fluoride (PVDF). The method of attaching the ties to the barrels may be an electrofusion method using specially manufactured fittings which have built-in heating elements that are used to weld the joining parts together. It should be noted that if alternative materials are used in the three basic components, that the alternative materials should match (i.e. PVC mated to PVC or HDPE to HDPE).

Figure 3A:
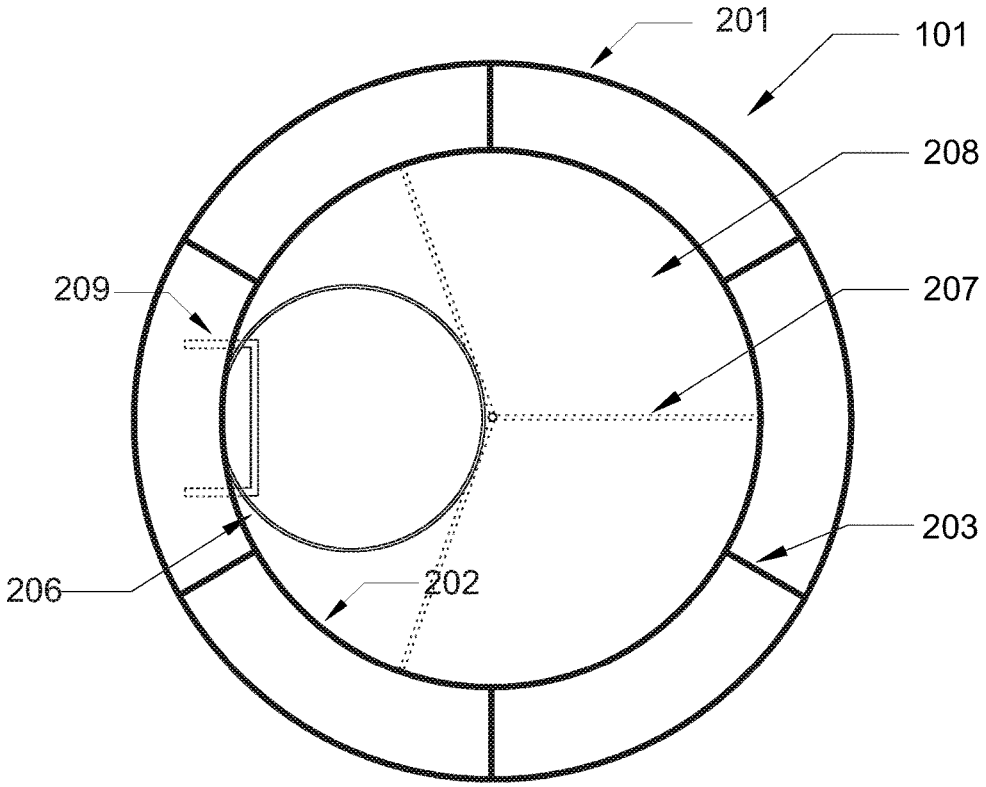
FIG. 3A is a top sectional view of an exemplary on-site manhole casting system in accordance with an embodiment of the invention.

FIG. 3A illustrates a top sectional view of an exemplary on-site manhole casting system in accordance with an embodiment of the invention. In this view, the top component 101 of the exemplary on-site manhole casting system is shown. In the preferred embodiment of the invention, at least six tie strips are 203 spaced equally apart and are welded perpendicularly to the outer diameter of the inner barrel 202 and the inner diameter of the outer barrel 201. Additionally, the tie strips 203 run parallel with the barrels and perpendicular to the ends of each component (i.e. base, main barrel and top). The bracing 207 consists of at least three units welded to the inner diameter of the inner barrel 202 and the underside of the cover 208, and is used for additional structural support when concrete is poured over the cover 208. Persons skilled in the art will recognize that a manhole entry barrel 206 may be created with a plastic material of a desired thickness. In the preferred embodiment of the invention, the manhole entry barrel is made of double-walled ribbed high-density polyethylene, or thin-walled HDPE in alternative embodiments, and is welded to the top component. A step ladder is created by fixing individual steps 209 through holes drilled in the inner barrel 202. Step ladder steps 209 are then inserted, and will be held in place by poured concrete.

Figure 3B:
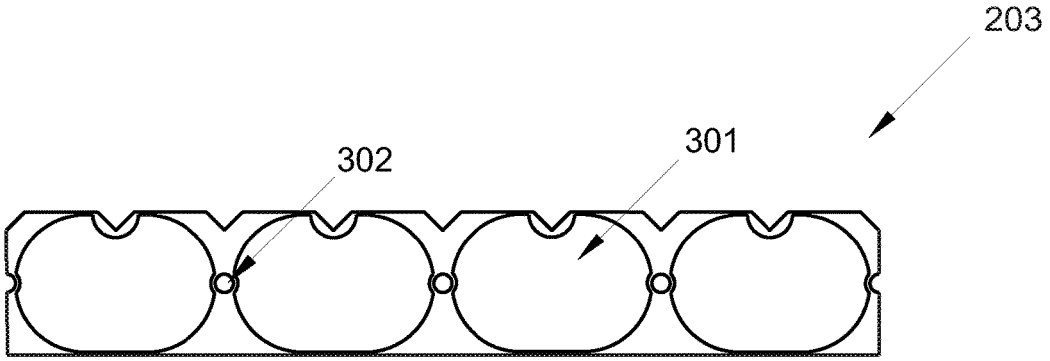
FIG. 3B is a front view of an exemplary tie strip in accordance with an embodiment of the invention.

FIG. 3B illustrates a front view of an exemplary tie strip in accordance with an embodiment of the invention. The tie strip 203 has a plurality of larger apertures 301 in the center region of each strip. The larger aperture provides for poured concrete to cure into a rigid and contiguous structure. The tie strips also have smaller apertures 302 which allow for the use of reinforcing wire or reinforcing bars to be threaded through and supported the tie strips in order to meet or exceed design parameters. The tie strips 203 provide structural rigidity for the plastic forms while holding the concentric barrels in a fixed position for concrete to be poured. Persons having skill in the art will recognize that the tie strips 203 with apertures 301 may be created in numerous ways such as, but not limited to, molding or cutting shapes out of flat-stock HDPE or other plastics.

Figure 4A:
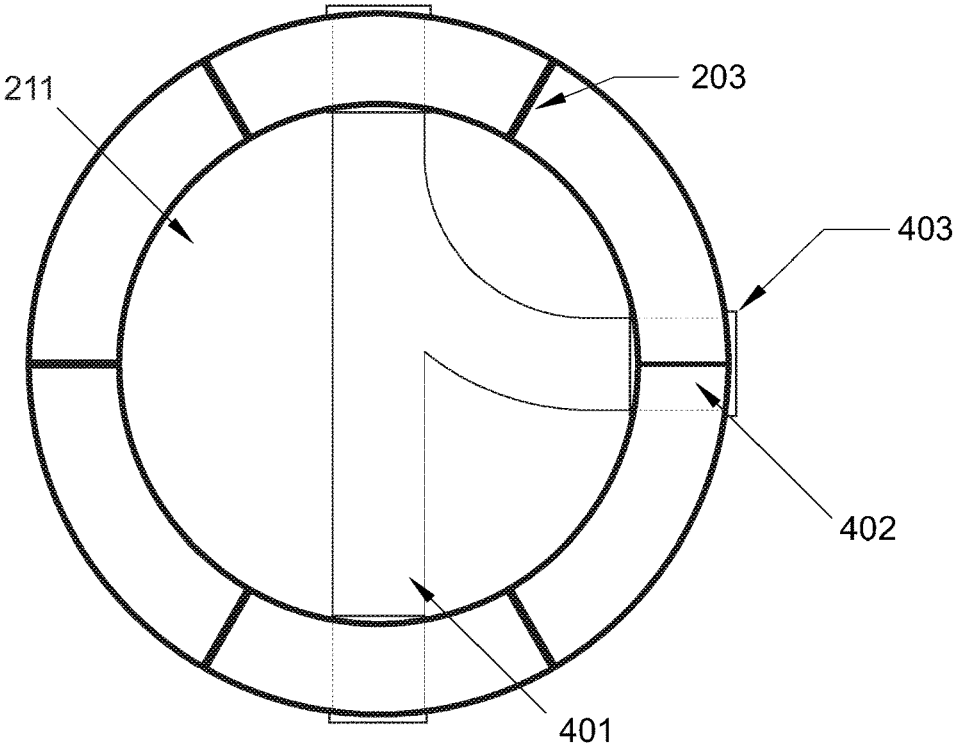
FIG. 4A is a top sectional view of the base component of an exemplary on-site manhole casting system coupling with sanitary sewer lines in accordance with an embodiment of the invention.

FIG. 4A illustrates a top view of the base component of an exemplary on-site manhole casting system in accordance with an embodiment of the invention. The manhole base form covered by the present invention can assume a wide variety of configurations. In the preferred embodiment of the invention, at least six tie strips are 203 spaced equally apart and used to provide structural support for the concentric barrels. In many instances, a manhole will be used in a direct line whereby a linear flow-through channel and openings in the opposite side walls of the base will be provided. In other instances, a manhole is located at the juncture of two or more sanitary sewer lines 401 where a plurality of flow channels are provided depending upon the number of lines involved. Persons having skill in the art will understand that such flow channel forms 211 may be created by specially molded plastics which ultimately create a concrete casting mold, or can be made from concrete which is custom poured on-site. Additionally, such a manhole base may be located in the main line of a sewer with branch lines feeding into the manhole and, in such instances, large diameter openings are associated in the same base with smaller diameter openings. The present invention is adaptable for the production of any of these variations in sewer constructions and for the production of many other variations which will be readily understood by those skilled in the art. Channel apertures 402 can be created either at a manufacturing facility or cut into the casting system on-site. Such apertures may be cut into the form by numerous means well understood by persons having skilled in the art. In the present invention, manhole connectors 403 of varying shapes and forms may be used to create a seal between fitted pipe segments.

Figure 4B:
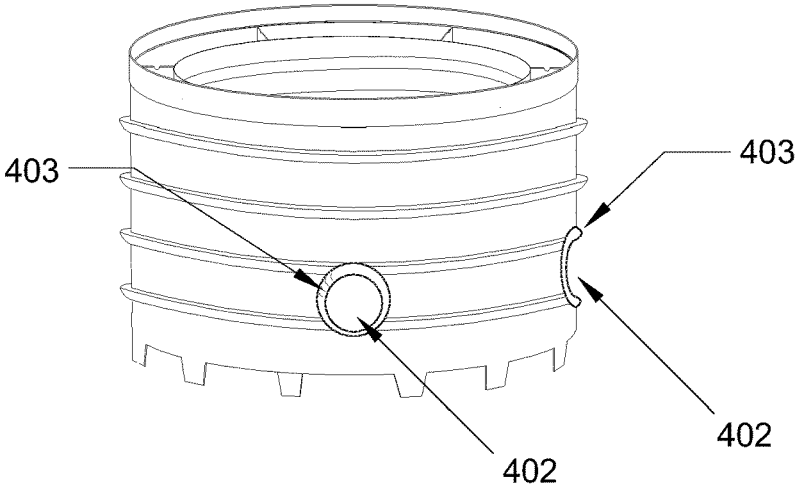
FIG. 4B is a perspective illustration of the base section of an exemplary on-site manhole casting system ready to couple with water or sanitary sewer lines.

FIG. 4B is a perspective illustration of the base section of an exemplary on-site manhole casting system ready to couple with water or sanitary sewer lines. Persons skilled in the art will understand that a manhole system should be able to accommodate varying types of sanitary sewer line configurations. Channel apertures 402 can be created either at a manufacturing facility or cut into the casting system on-site. Such apertures may be cut into the form by numerous means well understood by persons having skilled in the art. Manhole connectors 403 serve as a gasket between a manhole structure and other pipes and/or conduits which connect to the manhole assembly.

Figure 5:
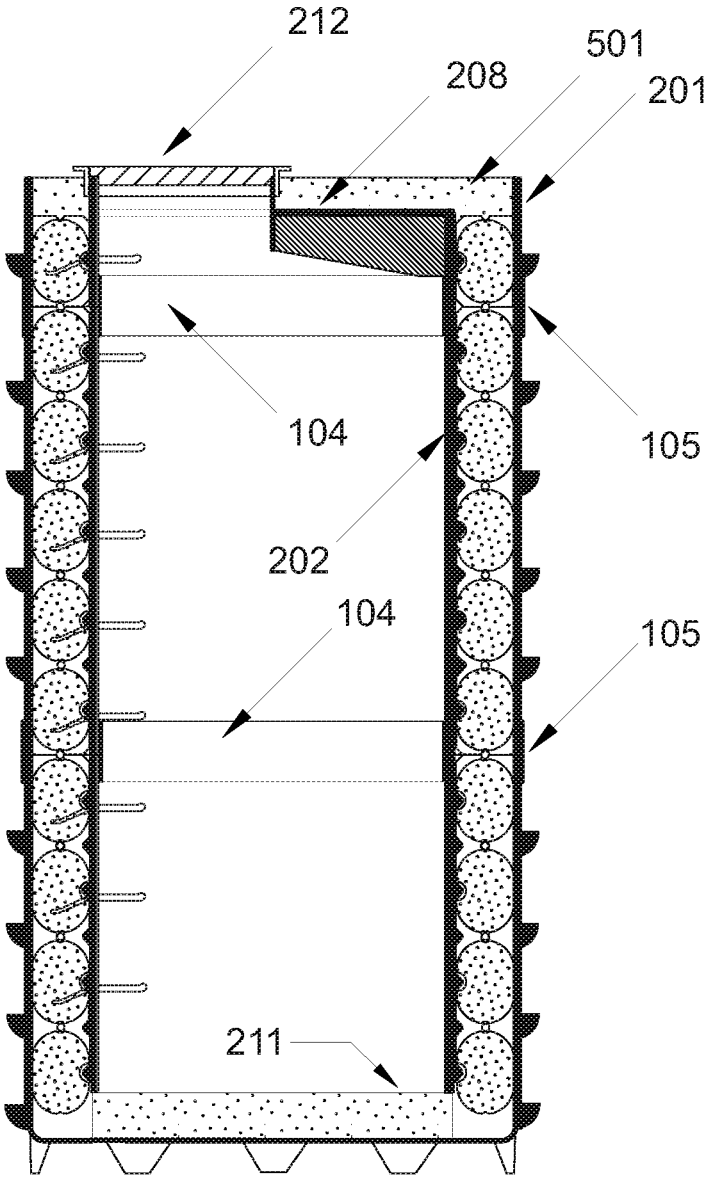
FIG. 5 is a cross sectional view of an exemplary on-site manhole casting system in accordance with an embodiment of the invention.

FIG. 5 is a cross sectional view of an exemplary on-site manhole casting system in accordance with an embodiment of the invention. In this representation, each basic component has been coupled together. An outer coupling ring 105 has been welded to the ends of the outer barrel 201 of each basic component. Additionally, an inner coupling ring 104 has been welded to the ends of the inner barrel 202 of each basic component. In the preferred embodiment, an industrial adhesive such as cyanoacrylate is used to create such a weld.

In FIG. 5, concrete has been poured in the space between the outer barrel 201 and the inner barrel 202, and at the base of the assembly in such a manner creating flow channel forms 211 and a bench. Concrete or fill dirt 501 has been placed on the cover 208. Persons skilled in the art will understand that a standard manhole cover assembly 212 may be attached to the manhole entry barrel 206 and held in place with a mastic seal.

Figure 6:
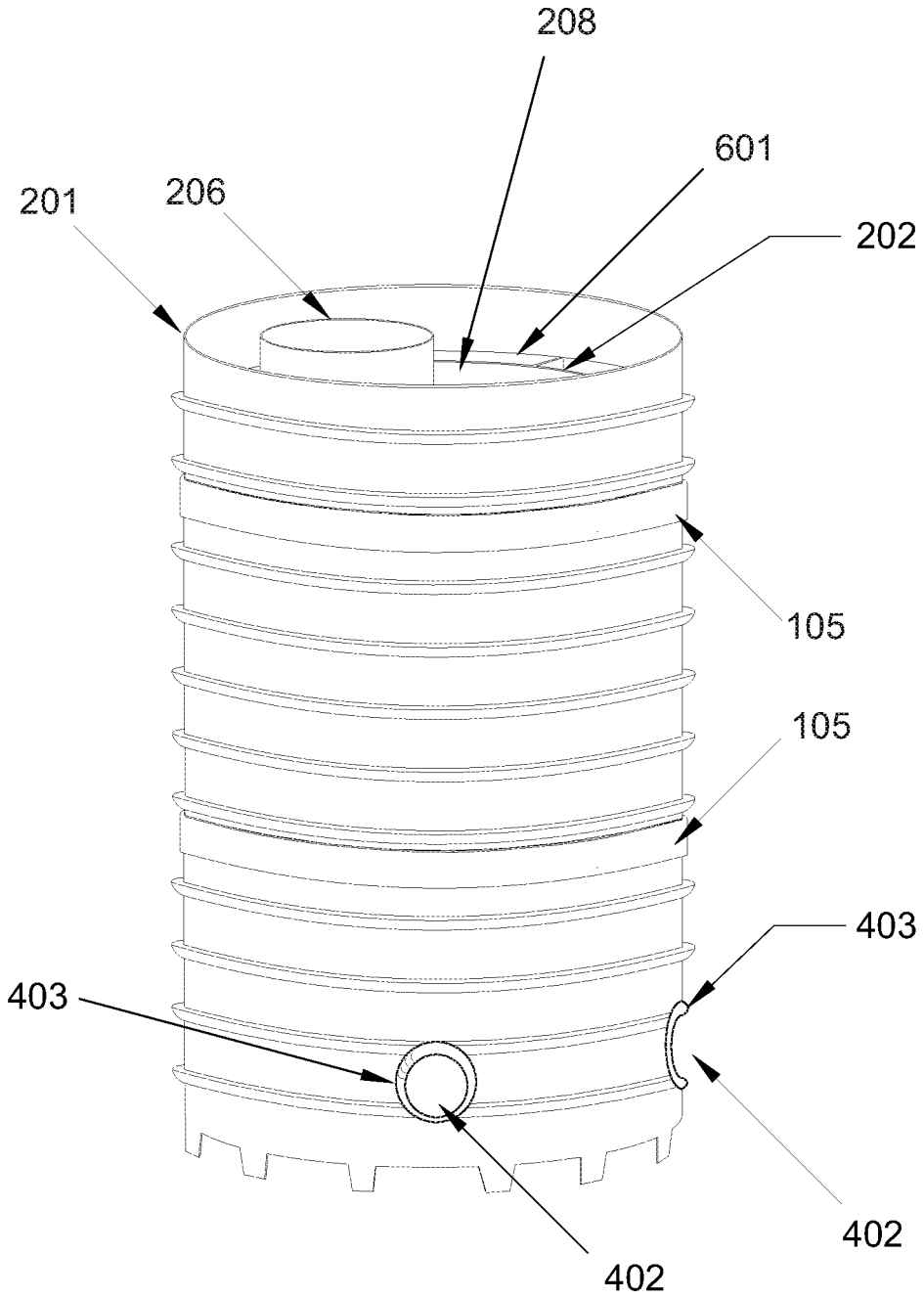
FIG. 6 is a perspective view of an exemplary on-site manhole casting system that has been fully assembled in accordance with an embodiment of the invention.

FIG. 6 is a perspective view of an exemplary on-site manhole casting system that has been fully assembled in accordance with an embodiment of the invention. As illustrated, the top, main barrel and base have been fitted and welded together. The outer coupling ring 105 is welded to the components so as to create a waterproof seal. Channel apertures 402 have been created, and may be fitted to conduits with manhole connectors 403 serving as a gasket between the manhole structure and other pipes and/or conduits which may be connected to the manhole assembly.

The assembled form can be lowered into an excavation, and water main and/or sanitary sewer lines may be inserted through the apertures created and coupled to the form. A concrete mixture is then poured into the space 601 between the outer barrel 201 and the inner barrel 202, filling from the bottom of the base unit to the top. In the preferred method of casting such a manhole assembly, a concrete vibrator is recommended to facilitate the concrete mixture in settling, and to remove any voids in the concrete mixture. Concrete may be poured over the cover 208 to enclose, but not cover, the manhole entry barrel 206. The excavation may be filled in either before or after the concrete mixture is poured depending on the particular application. The manhole assembly will be ready for use after a minimum concrete setting time.

Figure 7:
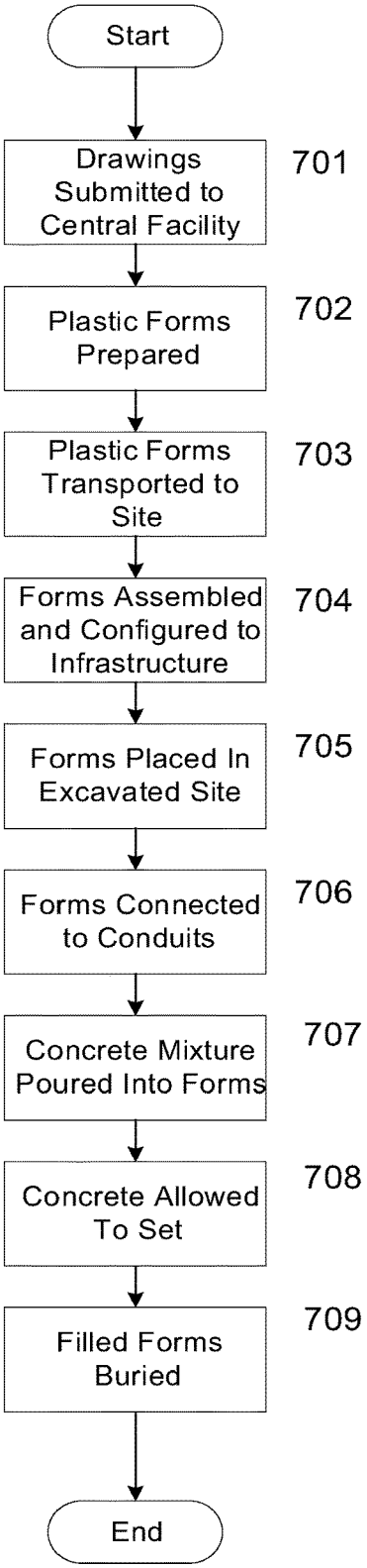
FIG. 7 illustrates a flow chart method of providing an on-site manhole casting system in accordance with an embodiment of the invention.

FIG. 7 illustrates a flow chart method of providing an on-site manhole casting system in accordance with an embodiment of the invention. Such a flow chart method is capable of being implemented across a wide variety of applications including, but not limited to, manhole assemblies, sanitary sewer pipes, aqueducts, utility conduits, and concrete structures. Persons skilled in the art will appreciate that in some alternative implementations, the functions noted in the block diagram may occur out of the order noted in the figures. For example, two blocks shown in succession may, in fact, be executed substantially concurrently, or the blocks may sometimes be executed in the reverse order, depending upon the functionality involved.

The exemplary on-site manhole casting system requires shop drawings to be submitted to a central facility 701. Such plans include, but are not limited to, manhole dimensions, whether reinforcing bars or wires are required, and types of conduits which may or may not be connected to the manhole assembly. The forms are then prepared in the facility 702. Preparation of the forms involves the welding of the outer and inner barrels together using tie strips, threading reinforcing bars or wires through apertures in the tie strips, and specially preparing parts for the top and base components. Apertures may be prepared at the central facility, or they may be cut on-site.

The prepared plastic forms are then transported to an excavation site 703 where the components are assembled and configured (e.g. holes cut and gaskets inserted for sanitary sewer conduits) to couple with the infrastructure for which the manhole assembly's drawings were submitted in step 701. Alternatively, the plastic forms may be assembled and configured at the central facility. The configured forms are then placed in the excavation 705, positioned to true vertical, and connected to whatever conduits are being run through the manhole 706.

When the manhole assembly has been fully welded together and connected to the conduits, a concrete mixture may be poured into the form 707. Alternatively, the conduits may be connected after concrete has been poured. More specifically, a concrete mixture is poured into the space between the outer barrel and the inner barrel. The concrete is allowed to set 708, and the filled form is then completely buried 709. Alternatively, the form may be partially buried to provide additional support before a concrete mixture is poured in the form.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the on-site manhole casting system, other equivalent or alternative methods of implementing the on-site manhole casting system according to the present invention will be apparent to those skilled in the art. Various aspects of the invention have been described above by way of illustration, and the specific embodiments disclosed are not intended to limit the invention to the particular forms disclosed. The particular implementation of the on-site manhole casting system may vary depending upon the particular context or application. By way of example, and not limitation, on-site manhole casting system described in the foregoing was principally directed to the casting of manhole components. However, similar techniques may instead be applied to other construction methods which implementations of the present invention are contemplated as within the scope of the present invention. Such possibilities include, but are not limited to, building or other fixed structure or concrete pipe construction. More particularly, the main barrel sections may be fitted together and laid horizontally to create reinforced concrete pipes. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the on-site manhole casting system are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. An on-site manhole casting system comprising a top component, a main barrel component, and a base component, each component consisting of:

a. a ribbed plastic outer barrel;

b. a ribbed plastic inner barrel;

c. a plurality of plastic tie strips used to connect the said outer and inner barrels;

d. a coupling mechanism consisting of a plastic outer coupling ring and a plastic inner coupling ring, both said coupling rings welded to the coupling ends of the top component, main barrel component and base component which connects the top, main barrel and base components; and e. a concrete mixture that is poured into the space between the coupled outer and inner barrels, where the poured concrete is allowed to set, and the filled manhole casting system is then completely buried.

2. The on-site manhole casting system of claim 1 wherein the ribbed plastic outer barrel is connected to the inner barrel by the plurality of plastic tie strips which are equally spaced apart and welded to said outer barrel and said inner barrel, and run parallel with said outer barrel and said inner barrel and are perpendicular to the ends of said outer barrel and said inner barrel.

3. The on-site manhole casting system of claim 1 wherein the plastic tie strips have apertures for the concrete mixture to form a contiguous structure.

4. The on-site manhole casting system of claim 1 wherein the plastic tie strips have apertures for reinforcing bars or reinforcing wires.

5. The on-site manhole casting system of claim 1 wherein the plastic material is High Density Polyethylene (HDPE).

6. The on-site manhole casting system of claim 1 wherein the plastic material is Polyvinyl Chloride (PVC).

7. The on-site manhole casting system of claim 1 wherein the plastic material is Polypropylene (PP).

8. The on-site manhole casting system of claim 1 wherein the plastic material is Polyvinylidene Fluoride (PVDF).

9. The on-site manhole casting system of claim 1 wherein the ribbed inner barrel is double-walled.

10. The on-site manhole casting system of claim 1 wherein the ribbed outer barrel is double-walled.

11. The on-site manhole casting system of claim 1 wherein the main barrel is designed to couple with other components, including additional main barrel components.

12. The on-site manhole casting system of claim 1 wherein the base, which has one end capable of accommodating a foundation with built in sanitary sewer channels or water main lines, with extensions protruding from said end, said extensions being designed to be pushed into the ground to hold the assembled manhole casting system in place.

13. The on-site manhole casting system of claim 1 wherein the top, which has one closed end with a manhole entry barrel and a bracing unit, is designed to couple with the main barrel.

14. A three-component on-site manhole casting system consisting of a top component, a main barrel component, and a base component, each component consisting of:

a. a double-walled and ribbed high-density polyethylene (HDPE) outer barrel;

b. a double-walled and ribbed high-density polyethylene (HDPE) inner barrel;

c. at least six tie strips, which contain apertures for reinforcing bars and for concrete to form a contiguous structure, which are welded to said ribbed high-density polyethylene (HDPE) outer barrel and said ribbed high-density polyethylene (HDPE) inner barrel, and run parallel with said outer barrel and said inner barrel and are perpendicular to the ends of said outer barrel and said inner barrel;

d. the three components coupled to one another with coupling rings welded to the coupling ends of each component; and e. a concrete mixture poured into the space between the outer and inner barrels of the coupled manhole casting system.

15. The on-site manhole casting system of claim 14 wherein the the main barrel, is designed to couple with the other components through the use of an outer coupling ring and an inner coupling ring said coupling rings being chemically welded to the ends of said main barrel and said other components.

16. The on-site manhole casting system of claim 14 wherein the base, which has a footing with multiple plastic extensions designed to settle in the ground an excavation site and has one end capable of accommodating a foundation with built in sanitary sewer channels or water main lines, is designed to couple with the main barrel through the use of an outer coupling ring made of the same plastic material as said base and said main barrel and an inner coupling ring made of a plastic material, said coupling rings being chemically welded to the ends of said base and said main barrel.

17. The on-site manhole casting system of claim 14 wherein the top, which has one closed end with a cover and a manhole entry barrel and a bracing unit, is designed to couple with the main barrel through the use of an outer coupling ring made of the same plastic material as said top and said main barrel and an inner coupling ring made of a plastic material, said coupling rings being chemically welded to the ends of said base and said main barrel.

18. The on-site manhole casting system of claim 14 wherein more than one main barrel may be coupled together to form separate conduits.

19. A method of producing a manhole as described in claim 1 comprising the steps of:

a. submitting drawings to a central facility;

b. preparing the plastic components;

c. transporting the plastic components to a construction site;

d. assembling and configuring the plastic components;

e. placing the assembled plastic components in an excavated site;

f. fitting and connecting conduits to the base component;

g. pouring a concrete mixture into the fitted and connected plastic components;

h. allowing the concrete mixture to cure; and i. Burying the filled components.

* * * * *